United States Patent [19]

Jacoby

[11] 4,029,136

[45] June 14, 1977

[54] SELECTIVE GOLF CLUB DISPENSER

[76] Inventor: Raymond C. Jacoby, 299 SW. 7th Ave., Royal Oak Hills, Boca Raton, Fla. 33432

[22] Filed: Feb. 9, 1976

[21] Appl. No.: 656,379

[52] U.S. Cl. ..... 150/1.5 R

[51] Int. Cl.[2] ..... A63B 55/00

[58] Field of Search ..... 150/1.5 R, 1.5 B, 1.5 C; 220/93; 211/60 G; 312/73

[56] References Cited

UNITED STATES PATENTS

| | | | |
|---|---|---|---|
| 1,086,065 | 2/1914 | McAdam | 206/252 |
| 1,795,849 | 3/1931 | Epple | 220/93 |
| 1,990,894 | 2/1935 | Brubaker | 220/93 X |
| 2,595,987 | 5/1952 | Shears | 150/1.5 R |
| 2,799,315 | 7/1957 | Strasburg | 150/1.5 R |
| 2,950,748 | 8/1960 | Olinghouse | 150/1.5 R |
| 2,985,462 | 5/1961 | Stamp | 150/1.5 C X |
| 3,101,108 | 8/1963 | Ingoldt | 150/1.5 R |

*Primary Examiner*—Donald F. Norton
*Attorney, Agent, or Firm*—Malin & Haley

[57] ABSTRACT

A device attached to a golf club carrier which allows the golfer to automatically select a particular club by elevating the selected club above the other remaining clubs sufficiently to aid the golfer in removal of the club from the club carrier. The device includes a golf club receptacle having a plurality of club receiving tubes which house the handle and shaft individually of each club, a means for elevating each club individually relative to the other clubs and a club selector panel which allows the golfer to selectively actuate the club elevating means.

5 Claims, 8 Drawing Figures

Fig. 1.
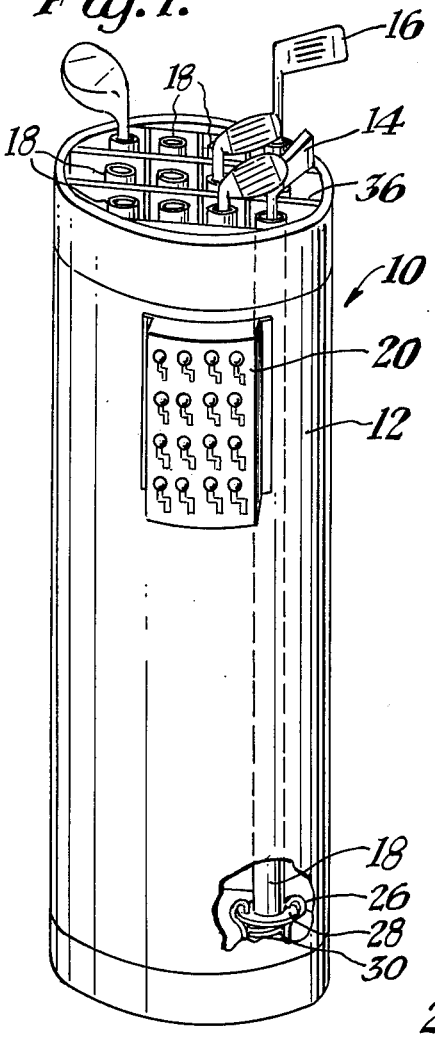
Fig. 2.
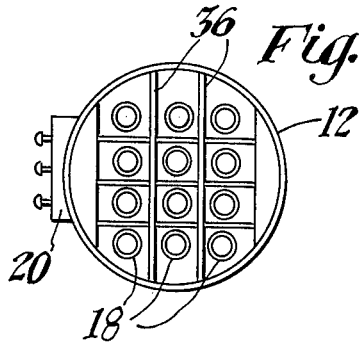
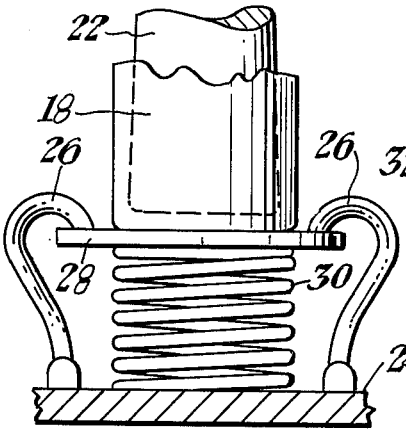
Fig. 3.
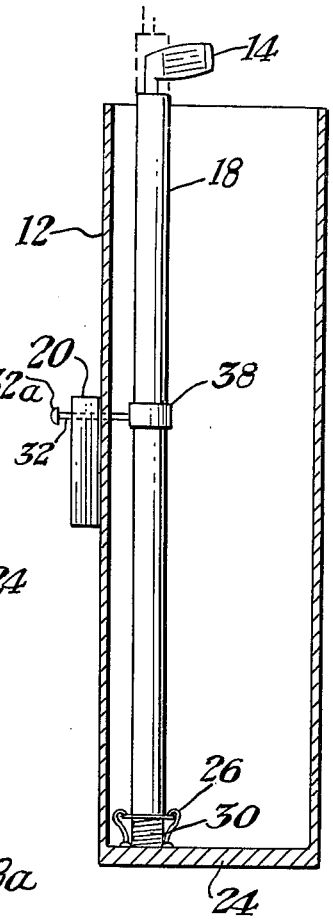
Fig. 5a.
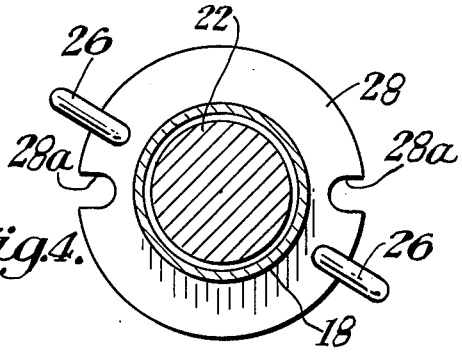
Fig. 4.
Fig. 6.
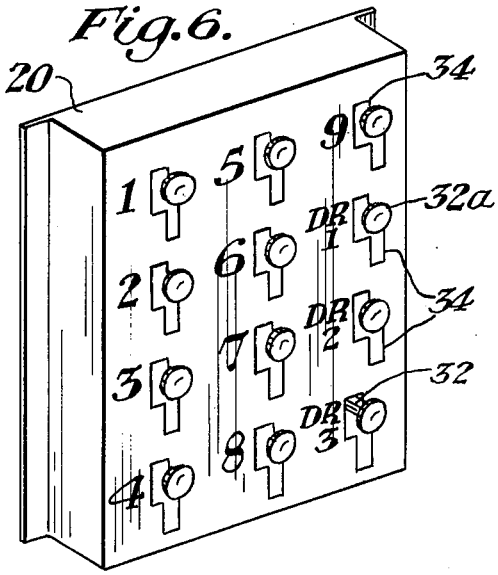
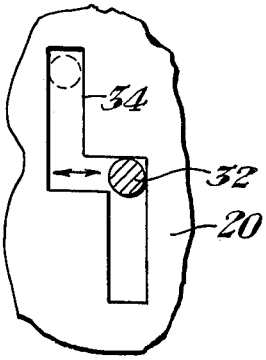
Fig. 7.
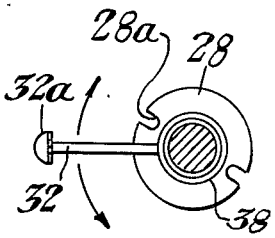
Fig. 5b.

SELECTIVE GOLF CLUB DISPENSER

BACKGROUND OF THE INVENTION

This invention relates generally to an automatic golf club dispenser which allows a golfer to more easily remove a particular club from a golf bag, and specifically to a mechanically or electrically actuated individual club dispensing means which is housed within a golf club bag in which a golfer may individually select and actuate the individual club dispensing means.

As is well known to those who golf, the golfer must carry a variety of different golf clubs which are individually utilizable at different locations on the golf course when playing a round of golf. In addition, many golfers have more than the conventional number of clubs to provide for specialized type of club utilization in particular situations. However, many of the club heads look quite similar and oftentimes it is possible for the player to confuse particular clubs and select the wrong club from the bag. This can slow down the game and result in distraction to the golfer resulting in a waste of time which diminishes the enjoyment of the game. In most situations, each player knows the particular club that is necessary or desired for the next shot, but oftentimes, because of club similarities, he will remove the wrong club from the bag resulting in a poor shot or wasted time.

With the use of the instant invention, these problems are overcome because a golfer can select from a readily observable display panel a particular club by number and actuate a selector knob adjacent the club number which causes the particular desired club to be elevated sufficiently above the other stored clubs so that the proper club is easily removeable from the bag.

BRIEF DESCRIPTION OF THE INVENTION

A device mountable with a golf club carrier to provide selective positioning of a particular golf club relative to a plurality of other clubs comprising a receptacle for receiving a plurality of golf clubs, a plurality of individual golf club holders disposed within said receptacle, a golf club selector means which includes a display panel having indicia for identifying particular golf clubs diposed thereon, a plurality of selector arms, each of said selector arms being connected to a different club holder, a plurality of club raising means, each connected to said receptacle bottom and individually coupled to different club holders and a means for selectably latching and retaining said club raising means in a locked position connected to the selector arm.

In one embodiment, the exterior receptacle is shaped like a conventional golf bag with a cylindrical body and a closed end portion. Within the larger receptacle a plurality of rigid tubes each of which receive a golf club shaft are inserted, with the number of tubes being equal to the number of particular clubs contained in the golf bag. Each tube is large enough in diameter and is hollow to receive the shaft and handle of a conventional golf club. Since the actuation and operation of each tube is similar, the invention will be discussed relative to a particular club. The bottom of the receptacle include, in one embodiment, a plurality of springs connected thereto which contact the closed ends of the tubes. A latch plate having a pair of apertured slots is connected to the bottom of each tube. A pair of latching hooks which communicate with the latch plate are fastened to the bottom of the club receptacle on each side of each spring. Each club receiving tube may be vertically disposed into one of two positions. The first position is with the spring depressed against the bottom of the receptacle and the bottom of the club retaining tube, with the latch plate being rotated so that the tube and club are held against the spring tension. This is the "down" position in which all of the clubs would be disposed prior to actuating the device. In the second position, a particular club retaining tube is rotated which causes its latching plate to rotate until the latching hooks are disposed over slots in the latch plate which allows the spring to release causing the tube and club within to rise vertically, causing the club head to be positioned a predetermined distance above the other club heads, which have not been selected.

A selector for selecting a particular club is mounted on the side of the club receptacle and includes a display panel having a plurality of club reference indicia and a plurality of actuating arms, each of which is connected to a different club receiving tube. The display panel includes a plurality of slots, each of which receive an actuating arm and are shaped to allow vertical and horizontal movement. The slots also allow the actuating arms to be locked to prevent inadvertent actuation of the device.

It is an object of this invention to provide a golf club selector which is mechanically actuated to allow for individual preselected dispensing of a particular golf club.

It is another object of this invention to expedite individual golf club selection by providing a readily observable visual indicator for individual club removal from a golf club bag which eliminates the necessity for observing each particular club head for proper club selection.

And yet another object of this invention is to provide a golf club sorting device which separates and individually prevents the clubs from mutual contact in a golf club bag and which allows a player to mechanically select a particular club from a visualized selector panel which elevates the selected club above the remaining clubs in the bag for rapid club removal.

In accordance with these and other objects which will be apparent hereinafter, the instant invention will now be described with particular reference to the accompanying drawings.

BRIEF DESCRIPTION OF THE DRAWINGS

FIG. 1 shows a perspective view of the instant invention with a partial cut-away section.

FIG. 2 is a top plan view of the instant invention.

FIG. 3 is a side elevational view partially in cross-section and fragmentary showing the club actuating mechanism as utilized in the instant invention.

FIG. 4 is a top plan view partially in cross-section of the actuating mechanism utilized in the instant invention.

FIG. 5*a* is a side elevational view partially in cross-section of the instant invention.

FIG. 5*b* is a top plan view of the actuating mechanism utilized in the instant invention.

FIG. 6 is a perspective view of the selector panel and the club indicia display as utilized in the instant invention.

FIG. 7 is a front elevational view of the selector panel actuating slot as utilized in the instant inveniton.

PREFERRED EMBODIMENT OF THE INVENTION

Referring now to the drawings and specifically FIG. 1, the instant invention is shown generally at 10 comprised of a golf club receptacle 12 which is substantially cylindrical in shape and includes a closed bottom end and a top opening. Within the golf club receptacle are a plurality of separator bars 36 to maintain separation between the individual clubs 14 and the extended club 16 which is discussed in greater detail below. Each club is disposed within a tube-like retainer 18 which receives the shaft and handle 22 of the club and positions and holds each club in the receptacle 12 such that the club head is disposed outwardly from the top of the receptacle. The club retainers 18 are also utilized for the invention to position a particular club head vertically such that the club head 16 may be disposed above the other clubs in the bag for easy removal from the golf bag. A club selector panel 20 is disposed on the side of the receptacle 12 and is connected thereto which has a display face with indicia representative of a particular golf club contained within the receptacle and a hand-actuated mechanism which allows one to select an individual club and position it above the remaining clubs.

FIG. 2 shows the receptacle or golf bag including the dividers 36 oriented at the top of the bag which are rod-like and merely act to sort and keep the club heads from contacting each other. The individual club retainers 18 are disposed along the longitudinal axis direction of the receptacle and are separated by the dividers 36. The selector panel 20 is connected to one side of the device. The device as shown may function and be inserted as a separate receptacle into a conventional golf bag or may serve itself as a golf bag.

Looking at FIGS. 1 and 3, the positioning mechanism is shown which allows an individual club to be selected and raised vertically so that its club head is above the other clubs for easy selection by the player. The actuating mechanism for each individual club is the same so that only one shall be described. The club retaining means 18 has a latching plate 28 connected to its bottom end. Disposed beneath the latching plate 28 and connected thereto is a spring 30 which is also coupled at its opposite end to the bottom 24 of the golf club receptacle. A pair of hook-shaped latches 26 which can engage the upper surface of the latching plate 28 are connected to the golf club receptacle bottom 24. The handle 22 or shaft of an individual club is disposed within the tube-like body of the club retaining means 18. In this position as shown in FIG. 3, the particular club would thus be positioned with the other clubs and is locked down by the latches 26 in a down position against the spring tension.

FIG. 4 shows the latching plate 28 which includes a pair of slots **28*a* which are alignable with latches 26 such that when the plate 28 is rotated, the slots 28*a* will be aligned with the latches 26,** permitting vertical movement. This moves the plate, the club retaining means and any club contained therein upward in a vertical direction to achieve a second position which is elevated above the other particular clubs that are downlocked in the bag.

FIGS. **5*a* and 5*b* show how the latching plate rotation is accomplished. The selector panel 20 mounted on the front of the receptacle 12 includes a plurality of actuating arms 32 connected through the selector panel and each individually connected to a different club retaining means by a connector 38. As shown in FIG. 5*a*, club 14 which is disposed within club retainer 18, is locked in the down position against the tension of spring 30 by the latches 26. The actuating arm 32 is disposed within a slot 34 (shown in FIG. 7) which allows for horizontal or rotational movement to be applied to the arm 32 causing the club retainer 18 and the latching plate 28 connected thereto to rotate, aligning the slots 28*a* in the latching plate with the latches 26, freeing the club retainer 18 so that the spring 30 causes it to rise when the plate slot 28*a* are aligned with the latches 26. Thus as shown in FIG. 7, the horizontal portion of each slot is utilized to achieve rotational movement of the latching plate. The vertical portions of slot 34 on the display panel 20 allow each actuating arm 32** to move or lock to control the movement of the club retaining means connected thereto.

FIG. 7 shows different positions of the actuating arm 32 (dotted in the upward club elevated position).

Referring back to FIG. 1, after a club has been removed from its club retaining tube and been utilized, the player need only put the club back into the club retainer tube, depressing the tube and club against the spring tension and rotating the actuating knob **32*a*** on the display panel to achieve the downlocked position to reposition the latches against the latch plate surface. The actuating knob on the selector panel is returned to the locked position.

Referring back to the selector panel, FIG. 6, it is shown that each slot 34 has an actuating arm 32 and a knob **32*a* and adjacent the slot 34 is disposed a particular number which is representative of a particular golf club which may be selected. Thus in utilizing the instant invention, the player need not fumble around the bag trying to identify a small number on the club head but need only move the appropriate actuating arm on the selector panel 20 to cause the desired club to be elevated to a position as shown in FIG. 1 in which club head 16** is raised above the remaining clubs in the bag. Since the club retaining tube also moves upwardly, the club is more easily returned to the bag in the proper position since the club retaining tube will be raised above the other retaining tubes in the bag.

Although the club selector has been shown utilizing mechanical stored energy in the form of a spring, other alternative embodiments could be accomplished using electro-mechanical or electrical means.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A golf club receptacle having an individual club selector for selective positioning of a particular club within the receptacle comprising:

a golf club receptacle having an open end;

at least one individual club receiving means disposed in said receptacle;

selective club positioning means connected to said receptacle and said club receiving means for moving a particular club receiving means from a first position to a second position;

said selective club positioning means for moving said club receiving means includes a selector panel having indicia representative of individual golf clubs, and individual movement actuating means connected to said panel and said club receiving means.

2. A golf club receptacle and selector, as in claim 1, wherein:

said individual club receiving means is tubular in shape and can receive the handle and shaft of a golf club, said tubular body being disposed within said golf club receptacle.

3. A golf club receptacle and selector, as in claim 2, wherein said selective club positioning means includes:

resilient force producing means connected to the bottom of said golf bag receptacle and at the opposite end to said club receiving means, and means for locking said resilent means in a first compressed position.

4. A golf club selector in combination with a conventional golf bag comprising:

a golf bag;

means mounted within said golf bag for raising and lowering a golf club from a first position to a second position within the bag. and an actuating means including an indicia display panel representative of a particular golf club connected to said golf club raising and lowering means whereby a player may select an individual club and position it above the remaining clubs in the golf bag.

5. A golf club holder and selector for selecting positioning of a particular club contained in the club receptacle comprising:

a golf club receptacle being substantially cylindrica in shape and having a closed end;

a plurality of individual club shaft receiving means, each of said club shaft receiving means being tubular in shape and being disposed within said golf club receptacle in the longitudinal direction of the receptacle, each of said club shaft receiving means having a base;

a plurality of latching plates, one of each connected to a different base of said club receiving means, each of said plates including at least one slot;

a plurality of springs connected to the bottom of said receptacle and engaging said latching plate;

a plurality of latches, each connected at one end to the bottom of said receptacle and each having an upper end engageable with one of said plates;

a selector panel;

an actuating means disposed through said selector panel and connected to each of said club receiving means for rotating a particular club receiving means from a first position to a second position, the rotating movement aligning said particular plate slot with a cooperating latch whereby the spring will raise the individual club receiving means upon the rotational movement of the actuating arm.

* * * * *